343-755 SR
3/3/87 OR 4,647,938

United States Patent [19]
Roederer et al.

[11] Patent Number: 4,647,938
[45] Date of Patent: Mar. 3, 1987

[54] DOUBLE GRID REFLECTOR ANTENNA

[75] Inventors: Antoine G. Roederer, Noordwijk; Gerald A. E. Crone, Lisse, both of Netherlands

[73] Assignee: Agence Spatiale Europeenne, Paris, France

[21] Appl. No.: 665,933

[22] Filed: Oct. 29, 1984

[51] Int. Cl.[4] ..... H01Q 19/12; H01Q 19/195
[52] U.S. Cl. ..... 343/756; 343/761; 343/840
[58] Field of Search ..... 343/756; 34/761, 840, 34/781 P, 779

[56] References Cited

U.S. PATENT DOCUMENTS

| | | | |
|---|---|---|---|
| 2,790,169 | 4/1957 | Sichak | 343/756 |
| 3,096,519 | 7/1963 | Martin | 343/756 |
| 3,696,432 | 10/1972 | Anderson et al. | 343/756 |
| 3,898,667 | 8/1975 | Raab | 343/756 |

*Primary Examiner*—Eli Lieberman
*Attorney, Agent, or Firm*—Bachman & LaPointe

[57] ABSTRACT

A double grid reflector antenna for radiating different signals having pure linear orthogonal polarization comprises a couple of identical and superposed reflecting grids. One of said grids has been rotated its boresight to disengage its focus from that of the other, and feeds are set in the focal plane of the respective grids. The front grid reflects indifferently either horizontal or vertical polarization, while transmitting the orthogonal polarization to be reflected by the rear grid.

7 Claims, 5 Drawing Figures

DOUBLE GRID REFLECTOR ANTENNA

BACKGROUND OF THE INVENTION

1. Field of the Invention

This invention relates to compact antennas capable of radiating different signals in the same or different directions, said signals having pure linear orthogonal polarizations.

2. Description of the Prior Art

The launching of satellites imposes strict requirements concerning size, weight, and resistance to acceleration forces of the payload. The antennas of the prior art which radiate in a wide coverage zone are generally very bulky and consequently unsuitable for use on satellites One prior art solution to this problem is the use of separate reflectors whose respective coverage areas are juxtaposed so as to radiate in a wide zone. But this solution almost automatically implies a large-size launch configuration of the satellite.

Another prior art solution to the problem is the use of only one main reflector, and polarization filters in the region of the primary feeds. For instance, one feed is placed near the focus of the reflector, whereas the other is placed near the image of this focus, in a subreflector which filters the appropriate polarization (see FIG. 1). However, in the case of wide coverage areas, the advantage of having only one main reflector is offset by the fact that a large filtering subreflector is required. In addition, and this is the main disadvantage of this system, cross polarization induced by the main reflector is not filtered, which seriously limits the performance of such a system.

A third solution is to use an antenna system having a double grid main reflector. In this case, the main reflector comprises two orthogonal grids, offset from each other in their plane of symmetry, and based on the same mother paraboloid (see FIG. 2). This enables the same mould to be used for producing the grids. The system further comprises separate primary feeds, with horizontal and vertical polarization (Sh and Sv), which are set at different offset angles according to their associated grid reflector. However, this double grid reflector system has the disadvantage that the two reflecting surfaces are different portions of the same paraboloid, so that the mould must be considerably larger than each reflector. On the other hand, the double grid reflector does indeed provide a large coverage zone, but the offset angle of one of the reflectors may have to be large in order to achieve full coverage of that zone. For instance, the use of such an antenna to cover Europe, and more particularly a zone situated between Ireland and Turkey on one hand, and Finland and Algeria on the other, would require the setting of two reflectors on the East- and West-oriented sides of a satellite. But the angular width of Europe would impose a very large offset angle, which results in considerable aberration. Moreover, if the coverage for each type of polarization is identical, the difference between the offset angles of the two reflectors involves the use of completely different feeds for each polarization type.

SUMMARY OF THE INVENTION

In accordance with an illustrative embodiment of this invention, the foregoing and other problems of the prior art are solved by providing an antenna comprising a couple of identical and superposed reflecting grids, one of said grids having undergone a rotation so as to disengage its focus from that of the other, while its associated feed has undergone a rotation in the same manner in order to readjust the coverage.

An object of the invention is therefore to provide a satellite antenna system which is compact in its launch configuration but is nonetheless capable of radiating in a wide coverage zone.

Another object of the invention is to construct a compact antenna with two superposed grids associated with two similar feeds respectively.

A further object of the invention is to reduce the weight size of an antenna system for radiating different signals having pure linear orthogonal polarization, namely by avoiding the use of polarization filters.

Other and further aspects of the present invention will become apparent from the following description with reference to the accompanying drawings.

BRIEF DESCRIPTION OF THE DRAWINGS

Referring now to the drawings, in which like references designate like parts in the several views.

DETAILED DESCRIPTION

Figure 3:
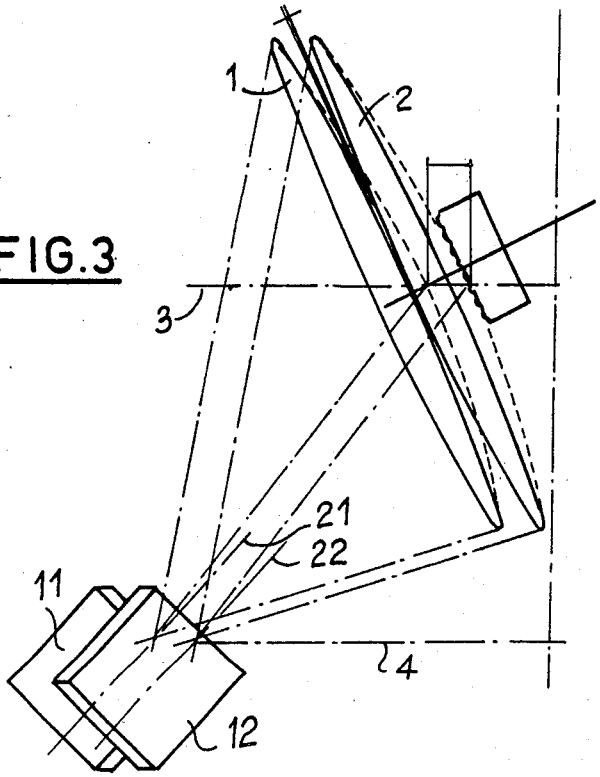
FIG. 3 schematically shows a side-view of an antenna system according to the invention.
Figure 4:
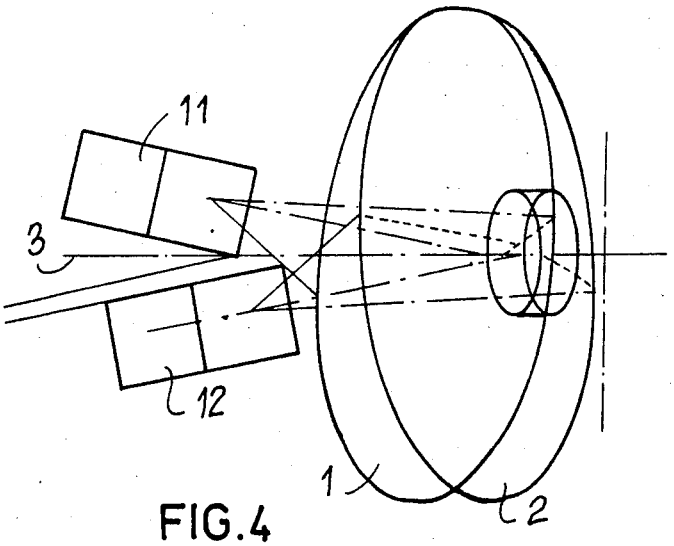
FIG. 4 schematically shows a top view of the antenna system of FIG. 3.

FIG. 3 and FIG. 4 illustrate the features of an embodiment of the antenna system according to the invention. The antenna comprises two offset reflectors 1 and 2, respectively associated with the two primary feeds 11 and 12.

Primary feed 11 operates in linear polarization, for instance horizontal, reflected by reflector 1. Primary feed 12 operates in linear orthogonal polarization, for instance vertical, reflected by reflector 2.

As opposed to the prior art grid reflector, the front and rear reflectors are identical off-center portions of the same paraboloid. Reflector 2 has been rotated around its boresight 3, while reflector 1 stays in place. The purpose of the rotation is to disengage the focus of reflector 2 from that of reflector 1 and thereby allow the juxtaposition of the two respective feeds 12 and 11. Both reflectors 1 and 2 have been previously slightly shifted apart from each other, in a direction parallel to the focal axis 4 to provide a clearance between said reflectors 1, 2 during this rotation.

It is then possible to place feeds 11, 12 in the focal planes of the two reflectors 1, 2. The feeds are slightly rotated around the respective rotation axis 21, 22, so as to readjust the coverage. The reflectors 1, 2 may or may not relate to different coverage zones.

Figure 1:
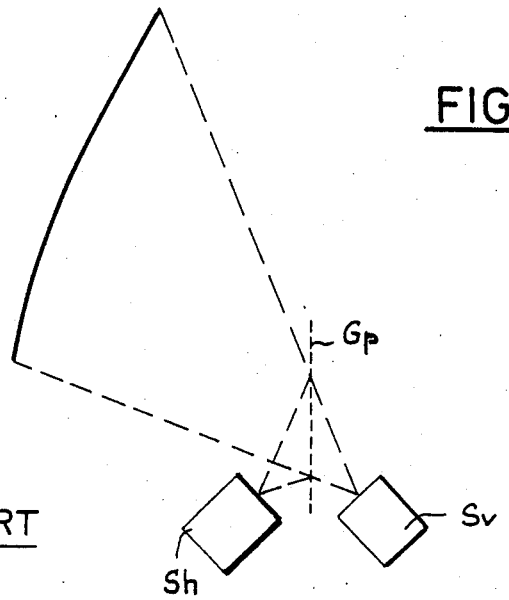
FIG.1 PRIOR ART
FIG. 1 schematically illustrates an antenna according to the prior art, with polarization separation at the feed level by a polarization grid.
Figure 2:
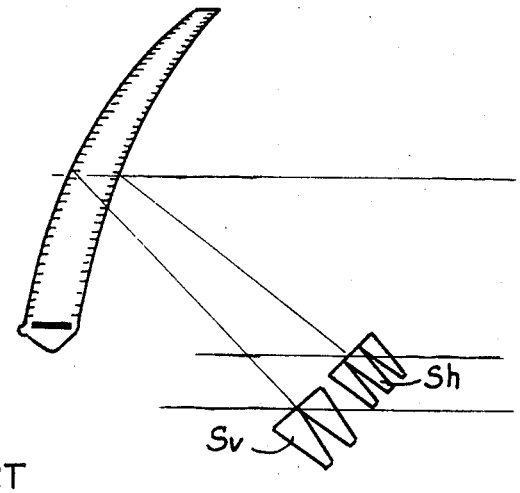
PRIOR ART FIG.2
FIG. 2 shows a cross-section of a conventional double-grid reflector antenna, whose grids are different portions cut from the same mother paraboloid.

As can be seen in the Figures, the system according to the invention differs from the prior art in that it radiates two very pure linear polarizations, and uses two identical reflector surfaces 1, 2, and two feeds 11, 12 of similar conception, separated by the plane of offset of the system (and not both situated in the plane of symmetry, as shown in FIG. 2 in respect of conventional antennas).

The feeds 11, 12 must in any case be placed in such a way that their main beam reflect on their respective reflectors 1, 2, so as to result in the same main beam 3, parallel to the focal axis 4.

According to a preferred embodiment of the invention, the primary feeds are conical horns, and a distribution network divides the power to be radiated between the horns.

Figure 5:
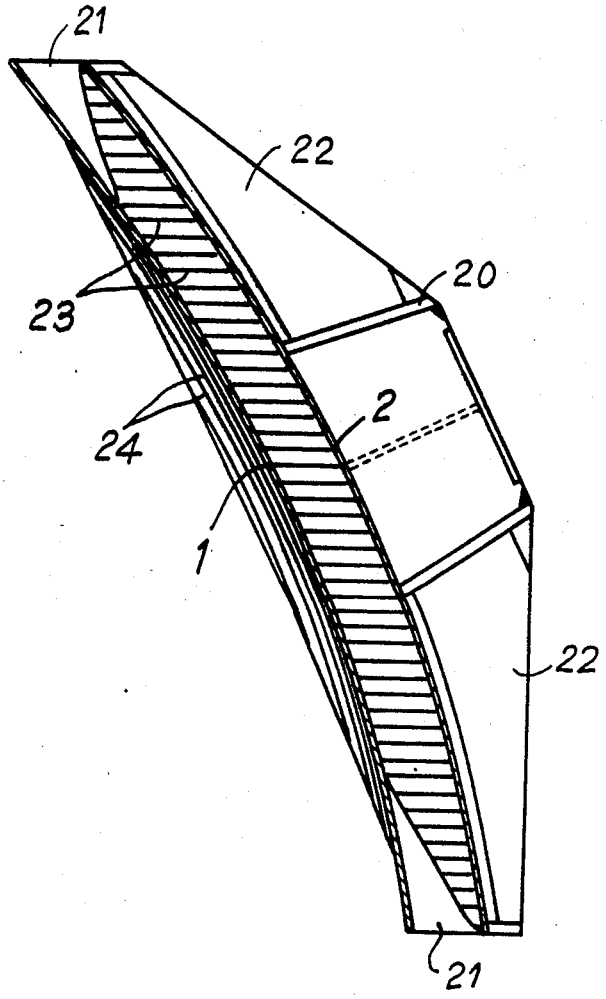
FIG. 5 is a cross-section of an preferred embodiment of the antenna system according to the invention.

Referring now to FIG. 5, a prototype of the antenna system has been constructed to meet the foregoing requirements.

It is constructed with a center ring 20 carrying both superposed front and rear reflectors 1, 2. The reflectors are linked to each other with a connection ring 21 mounted on the periphery of the structure. Four radial ribs 22 evenly spaced apart extend from the center ring 20 to the peripheral edge of the structure so as to enhance the rigidity of the antenna system.

In order to render the structure lighter, the center ring may be made of carbon/glass/epoxy, while the ribs are of a sandwich structure of kevlar, glass and nomex. The connection ring is of kevlar/glass/epoxy, and the rear reflector of a kevlar-nomex sandwich.

The front reflector 1 furthermore comprises a dielectric material provided with a device reflecting horizontal polarization and transmitting vertical polarization. The rear reflector 2 can be constructed according to the same principle, or can reflect both polarizations. Its purpose is to reflect vertical polarization.

It must be clearly understood that, alternatively, the front reflector may reflect vertical polarization, while the rear reflector reflects horizontal polarization.

According to a preferred embodiment, each reflector is equipped with polarization filtering strips 23, 24 (or wires), each reflecting one polarization and being transparent to the other. These strips are disposed on the reflector surfaces by metal deposition on grooved faces, followed by chemical erosion.

The exemplary embodiment described hereinbefore is illustrative of the application of the principles of the invention. It will be understood that, in the light of this teaching, numerous other arrangements may be devised by persons skilled in the art, without departing from the spirit and scope of the invention defined in the appended claims.

What is claimed is:

1. A double-grid reflector antenna for radiating different signals having pure linear orthogonal polarization, comprising a couple of reflecting grids cut out as portions of the same paraboloid, each grid cooperating with a respective feed, located at its focus, wherein said grids are identical and superposed, and one of the grids is rotatable around its boresight to shift its focus away from that of the other grid to vary the directions of the two orthogonally polarized beams to different directions, the grids having been slightly shifted away from each other, in a direction parallel to the focal axis so as to provide a clearance between said grids during the rotation, and each of said feeds being placed in the focal plane of its associated grid wherein the feeds can be counter rotated to store nominal orientation of the separate grid patterns.

2. A double-grid antenna according to claim 1, wherein said feeds are of similar design.

3. A double-grid antenna according to claim 1, wherein said reflecting grids relate to the same coverage zone.

4. A double-grid antenna according to claim 1, wherein said reflecting grids relate to different coverage zones.

5. A double-grid antenna according to claim 1, wherein one of said grids comprises a dielectric material provided with a device reflecting horizontal polarization, the other grid comprising a dielectric material provided with a device reflecting vertical polarization, said grids being indifferently superposed, and the grid located in front transmitting to the grid locating at the rear the linear polarization reflected by said rear grid.

6. A double-grid antenna according to claim 1, wherein the grid located at the rear comprises a device reflecting both horizontal and vertical polarization, the grid located in front reflecting either horizontal polarization or vertical polarization.

7. A double-grid antenna according to claim 1, wherein said grids are formed of a kevlar-nomex sandwich material and are connected by a connection ring made of a kevlar-glass-epoxy material.

* * * * *